United States Patent [19]

Greenwald et al.

[11] 4,128,156

[45] Dec. 5, 1978

[54] ANTI-SLUG MECHANISM FOR A COIN OPERATED DEVICE

[75] Inventors: Harry Greenwald, Whitestone; Dennis J. Larkin, West Hempstead, both of N.Y.

[73] Assignee: Walter Kidde & Company, Inc., Clifton, N.J.

[21] Appl. No.: 812,638

[22] Filed: Jul. 5, 1977

[51] Int. Cl.[2] ..... G07F 5/00

[52] U.S. Cl. ..... 194/61

[58] Field of Search ..... 194/61, 62, 63, 64, 194/65, 66

[56] References Cited

U.S. PATENT DOCUMENTS 3,205,995 9/1965 Hill ..... 194/61

*Primary Examiner*—Stanley H. Tollberg

*Attorney, Agent, or Firm*—McAulay, Fields, Fisher & Goldstein

[57] ABSTRACT

An anti-slug mechanism for use in combination with a coin operated device has a projection, carried on the coin carrier, which abuts or otherwise engages a stop carried on the anti-coin return spring of the device to limit the extent to which a coin may travel within the coin operated device when the coin is of an improper size.

4 Claims, 10 Drawing Figures

ANTI-SLUG MECHANISM FOR A COIN OPERATED DEVICE

Cross-Reference to Related Application

Reference is hereby made to the related application Ser. No. 774,963, filed Mar. 7, 1977 in the name of Harry Greenwald and owned by a common assignee.

BACKGROUND OF THE INVENTION

This invention relates, generally, to a coin operated control device for controlling an appliance or other apparatus, and, more particularly, to an anti-slug mechanism for use in the control device to prevent the unauthorized initiation of the operating cycle of the appliance or apparatus when other than a properly sized coin or similar object is inserted into the coin operated control device.

DESCRIPTION OF THE PRIOR ART

A coin operated appliance or other apparatus, such as the clothes washer or dryers used in commercial laundromats, are usually provided with coin operated control devices such as a rotary coin meter or coin slide assembly, which devices require the insertion of one or more coins of a proper size to initiate the operating cycle of the appliance. The length or duration of the operating cycle is controlled by an electrically operated timer which is part of the control device. Examples of such prior art control devices are disclosed in U.S. Pat. Nos. 2,915,692; 3,168,947; 3,172,520 and 3,614,681; and in the above-referenced related application.

In one form of such a control device, a ratchet wheel and a star wheel are rotatably mounted on a common shaft. Each of said wheels carries an eccentrically mounted pin or projection located at substantially an equal radial distance from the axis of the shaft. The pins, or projections, project toward one another and are adapted to engage upon rotation of one wheel relative to the other. The ratchet wheel is driven or stepped by a pawl assembly which, in turn, is operatively associated with a rotary coin holder, a coin slide assembly or solenoid assembly. In any case, deposit of a proper sized coin in the device permits the coin carrier to move the pawl assembly in a manner to stepwise rotate the ratchet wheel in a first direction, a distance of one tooth. Such rotation establishes an angular separation between the pins, or other projections, of the ratchet wheel and the star wheel.

A spring biased arm is provided which operatively connects the ratchet wheel to a switch. The operation is such that rotation of the ratchet wheel to a first position effects movement of the arm to a position which, in turn, effects movement of the switch to a closed state initiating the operating cycle of the appliance or other apparatus to be controlled. At the same time, the movement of the switch to its closed state also serves to energize an electrically operated timer which, in turn, effects rotation of a pin wheel attached to the timing motor shaft.

The rotation of the pin wheel causes the pins thereof to engage with the teeth of the star wheel and intermittently rotate said star wheel in the same direction of rotation as the ratchet wheel. Rotation of the star wheel will cause the pin, or other projection, thereof, to engage with the pin of the ratchet wheel and thereafter, continued rotation of the pin wheel effects conjoint rotation of the star wheel and the ratchet wheel in the first direction, due to the engagement of the wheels.

Movement of the ratchet wheel by the star wheel, from its first position wherein it activates the switch, to a second position, serves to displace the switch operating arm to a position to effect movement of the switch to its open state thereby deactivating the switch and terminating both the operating cycle of the mechanism controlled by the switch and of the timer.

The above-referenced related application teaches an improvement to the mechanism generally described above whereby unauthorized activation of the control device by means of shaking the device, is avoided.

A second means by which unauthorized activation of the device is attempted, is the use of improperly sized coins or other similar objects, in particular the somewhat circular shaped portion of the tabs which have been supplied for ease in opening cans of beverages or other goods. In control devices broadly categorized as rotary coin meters which have been designed for use with quarters, it has been found that the generally circular portion of the can opening tabs can be jammed into the coin receiving slot and, by jiggling the coin holder, obtain activation of the device.

SUMMARY OF THE INVENTION

It is an object of the present invention to avoid the surreptitious activation of a coin operated control device utilizing an improperly sized coin or other object by limiting the extent of travel of said coin or object into the device. This prevents the object from being jiggled or jammed into a position whereby it can transmit the motion of the coin carrier to the operatively associated pawl assembly for initiating the operating cycle of the control device, because the object, unless of proper size, is restricted from movement far enough into the device to operatively drive the ratchet wheel via said pawl assembly.

The prior art mechanisms, especially the rotary coin carrier type, normally provide an anti-coin return spring in the path of the coin which is operable to be pressed out of the path of the coin by the coin and thereafter return to its original position blocking the movement of the coin in a reverse direction. This prevents the retrieval of the coin after it has been moved a sufficient distance in a predetermined path to activate the device.

An anti-slug mechanism, according to the present invention, includes a stop carried on the anti-coin return spring and a projection carried on the coin carrier. The projection is disposed to engage the stop upon rotation of the coin carrier without any coin having been inserted in the device, or when an improperly sized coin or object is inserted into the coin receiving slot, to prevent rotation of the coin carrier a distance sufficient to activate the device. However, a properly sized object or coin carried in the coin carrier will press the spring out of its path thereby moving the stop, carried on the spring, out of the path of the projection. Unless the spring is pressed out of the way of the projection, the coin carrier will be prevented from traveling to its activating position due to the engagement of the projection carried on the carrier with the stop on the anti-coin return spring. By designing the ratchet wheel driving mechanism so that the timer is rendered operative only after the coin carrier projection has traveled beyond the stop on the anti-coin return spring, it is possible to prevent activation of the device unless the coin travels beyond the stop. In this simple and effective manner, the use of improperly sized coins and objects will be rendered ineffective to activate the device.

The above and other objects, features and advantages of the present invention will become more apparent from a consideration of the following detailed description when taken in conjunction with the accompanying drawings.

BRIEF DESCRIPTION OF THE DRAWINGS

In the accompanying drawings.

DESCRIPTION OF THE PREFERRED EMBODIMENT

Figure 1:
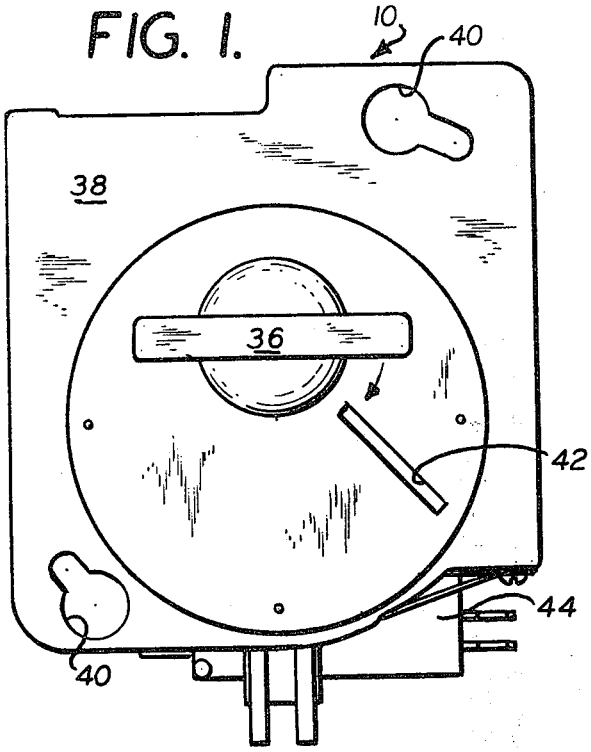
FIG. 1 is a front elevational view of the meter or coin operated control device incorporating the anti-slug mechanism of the present invention.
Figure 3:
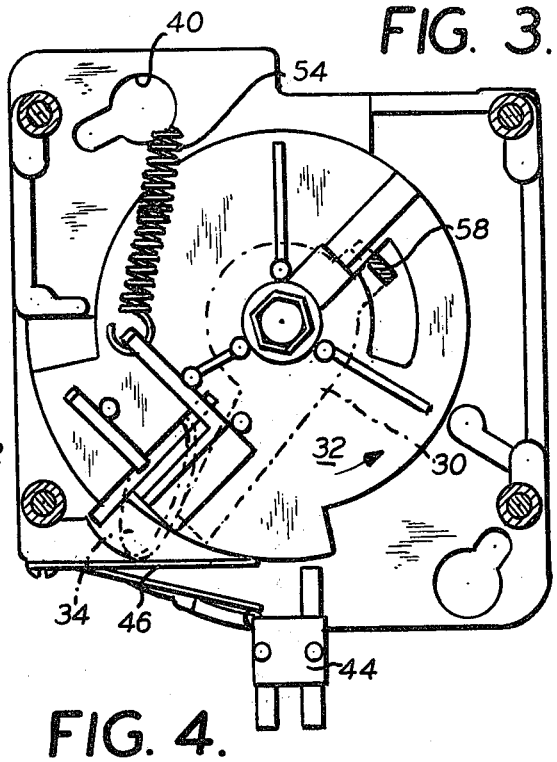
FIG. 3 is a cross-sectional view taken through line 3—3 of FIG. 2, showing a coin, in phantom, positioned in the coin carrier portion of the meter.
Figure 2:
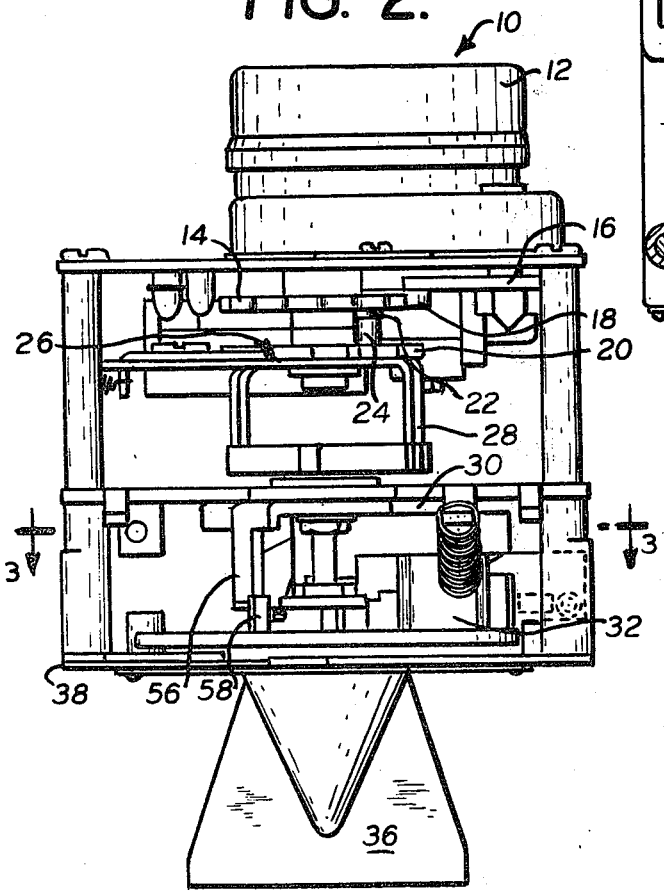
FIG. 2 is a top plan view thereof.

Referring to FIGS. 1–3, a coin operated control device 10 has an electrically operated timing motor 12 intermittently driving a star wheel 14 through a transmission comprising a pin wheel 16. The pin wheel 16 is rotated by the timing motor 12 and carries pins 18 which engage the star wheel 14 in gear-like fashion whereby the star wheel 14 is intermittently rotated upon rotation of pin wheel 16.

A ratchet wheel 20 is mounted coaxially with the star wheel 14. Both the star wheel 14 and the ratchet wheel 20 carry corresponding projections or pins 22, 24 respectively. When the star wheel 14 is driven with respect to the ratchet wheel 20, the pins 22, 24 will engage and thereafter the star wheel 14 and the ratchet wheel 20 will conjointly rotate.

The ratchet wheel 20 is driven or stepped by a pawl assembly 26 which, in turn, is operatively associated through linkage 28 to a coin driven member 30.

A coin holder 32, when supporting a proper sized coin 34, will be operable to support the coin in juxtaposed relation to the coin driven member 30. A knob 36 is secured to the coin holder 32 to allow manual rotation thereof. A mounting plate 38 supports the device 10 and has apertures 40 formed therein to permit mounting of the device on the apparatus to be controlled. The knob 36 extends outwardly from the front of the mounting plate 38. A slot 42 is formed in the mounting plate 38 to allow a coin to be inserted into the coin holder 32.

A proper sized coin 34 inserted into the coin holder 32 through the slot 42 allows the coin holder 32 to be rotated by means of knob 36 whereby the coin abuts the coin driven member 30, and thereafter acts as a transmission between the rotating coin holder 32 and the driven member 30. The rotatable driving of the coin driven member 30 rotates the pawl assembly 36 through linkage 28 causing the ratchet wheel 20 to rotate in a first direction a distance of one tooth. Such rotation establishes an angular separation between the star wheel projection 22 and the ratchet wheel projection 24.

The switch 44 is associated with the ratchet wheel 20 and, by usual means employing a ratchet tooth follower (not shown), is activated and deactivated in response to the rotational position of the ratchet wheel 20. Operation of the switch 44 activates and deactivates both the timing motor 12 and the apparatus which is controlled by the coin operated device 10.

As can be easily appreciated, the operation of the basic control device described above is as follows:

A coin 34 is inserted into the coin holder 32 through slot 42;

The coin holder is thereafter rotated, by means of knob 36, whereby the coin 34 will abut against and drives the coin driven member 30, as shown in FIG. 3;

The motion of the coin driven member 30 will be transmitted through linkage 38 to the pawl assembly 26 thereby rotating the ratchet wheel 20 and consequently operating the switch 44 to activate the timing motor 12 and the apparatus to be controlled;

The rotation of the ratchet wheel 20 separates the ratchet wheel projection 24 from the star wheel projection 22 and therefore the star wheel 14 must be driven for a predetermined time by the timing motor 12 through pin wheel 16 before the projections 22, 24 again abut.

Thereafter, the star wheel, through the engagement of projections 22 and 24 drives the ratchet wheel 20 until said ratchet wheel has reached a rotary position at which time the switch 44 is deactivated. This serves to turn off the timing motor 12 and the apparatus being controlled.

Figure 8:
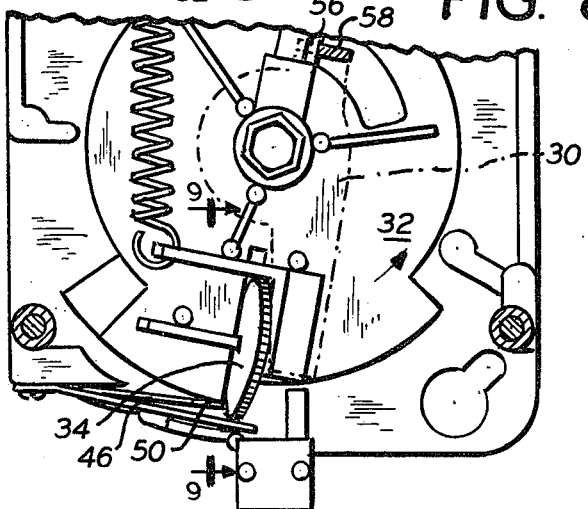
FIG. 8 is a view similar to FIG. 6 showing the coin carrier rotated to a position further along in its cycle of rotation whereby the engagement of the coin with anti-coin return spring prevents the coin carrier from being rotated in a counter direction to retrieve the coin.
Figure 9:
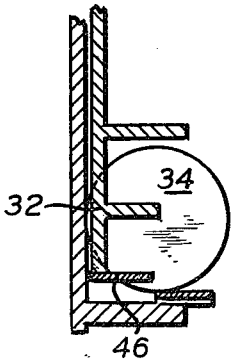
FIG. 9 is a partial sectional view taken through line 9—9 of FIG. 8.
Figure 10:
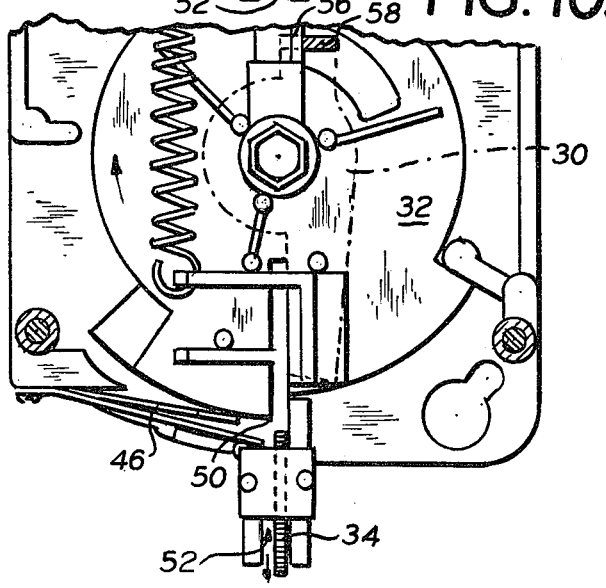
FIG. 10 is a view similar to FIG. 8 showing the coin carrier fully rotated to permit the coin to drop out of a suitable opening in the meter and into a coin receptacle.

In a coin operated control device 10 as described above, there is usually a provision, in the form of anti-coin return spring 46, to prevent the recovery of a coin after the device has been activated. As can be seen by comparing the FIGS. 3 and 8, the anti-coin return spring 46 is pressed downwardly out of the path of the coin 34 upon rotation of coin carrier 32, and thereafter springs back to block counter rotation of the coin carrier, as shown in FIG. 8. In other words, an attempt to counter rotate the carrier from the position shown in FIG. 8 will result in the coin 34 abutting the edge of the spring 46.

Figure 5:
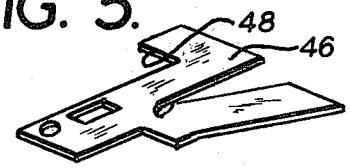
FIG. 5 is a perspective view of the anti-coin return spring.

As can be appreciated from FIG. 3, it is possible that an object smaller than the coin 34 can be wiggled and jammed between the coin carrier 32 and the coin driven memeber 30 to effectively rotate the coin driven member 30 as the coin carrier 32 is rotated. According to the present invention, the anti-slug mechanism includes a stop in the form of a cut-out 48 carried on the anti-coin return spring 46 (see especially FIG. 5). The anti-slug mechanism further includes a projection 50 carried on the coin holder 32. The projection 50 may be formed by an arcuate segment cut from the outer edge of the coin holder 32.

Figure 4:
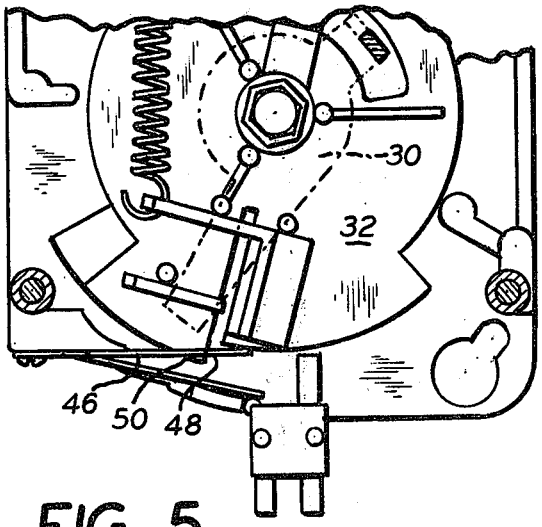
FIG. 4 is a partial view similar to FIG. 3 without the presence of a coin in the coin carrier portion, and wherein the coin carrier has been rotated to engage the anti-coin return spring to prevent further rotation of said coin carrier.
Figure 6:
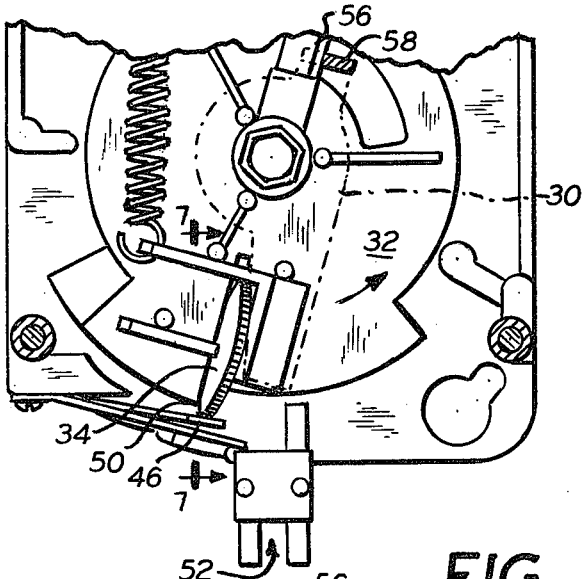
FIG. 6 is a view similar to FIG. 4 showing a proper sized coin in the coin carrier, and wherein the coin carrier has been rotated to a position wherein the coin pushes the anti-coin return spring out of the way to permit the coin carrier to be advanced to activate the mechanism.
Figure 7:
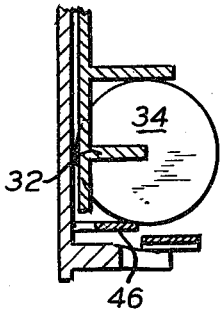
FIG. 7 is a partial sectional view taken through line 7—7 of FIG. 6.

Referring to FIG. 4, when the anti-coin return spring 46 is not pressed out of the way, the projection 50 engages an edge of the stop 48 thereby limiting the maximum rotation through which the coin holder 32 may be rotated by the knob 36 to a frist angular distance. When a properly sized coin 34 is carried in the coin holder 32, as shown in FIGS. 3 and 6, the anti-coin return spring 46 is pressed out of the path of travel of the projection 50. This permits the coinholder 32 to rotate through a second angular distance carrying the coin 34 into driving engagement with the coin driven member 30. When the coin 34 becomes disposed over coin exit opening 52, it drops from the coin holder into a coin storage container (not shown). Spring 54 thereafter returns the coin holder to its original position for receiving additional coins 34 through slot 42. Finally, as can been seen in FIG. 2, an arm 56 formed on the coin driven member 30 engages a corresponding arm 58 formed on the coin holder 32 when the coin holder 32 is returned to its original position thereby moving the coin driven member 39 back to its original point as well.

There is thus provided an improved control device for a coin operated mechanism having novel restraining means to prevent the initiation of the operating cycle of the mechanism using objects or coins of an incorrect size. While a preferred embodiment of the invention has been shown and descirbed in detail, it will be readily understood and appreciated that numerous omissions, changes and additions may be made without departing from the spirit and scope of the present invention.

What is claimed is:

1. In a coin operated timing device of the type having a switch actuated timing motor; a star wheel; first transmission means associated with the timing motor and operable to rotatably drive the star wheel in a first angular direction when the timing motor is activated; a ratchet wheel mounted coaxially with the star wheel and being operable, in engagement with a switch, in a first rotary position, to activate the timing motor, and in a second rotary position, to deactivate the timing motor; the star wheel and the ratchet wheel, each bearing a projection at substantially the same distance from the coaxial mounting and which projections are operable to mutually abut, whereby rotation of the star wheel will rotatably drive the projection thereof into abutment with the projection on the ratchet wheel and thereafter cause the ratchet wheel to rotate conjointly with the star wheel in the first angular direction, driving the ratchet wheel into its second rotary position whereby the timing motor is deactivated; first driving means operable to rotatably drive the ratchet wheel in the first direction and into the first rotary position, thereby to increase the distance between the projections when measured in the first angular direction and to activate the timing motor; second driving means being rotatable; second transmission means comprising a coin carrying plate adapted to receive a predetermined sized coin and being operably connected between the first driving means and the second driving means; the second driving means being rotatable through a first predetermined angular distance and thereafter, when carrying the predetermined sized coin in the coin carrying plate, through a second predetermined angular distance; rotation of said second driving means in the first direction over its second predetermined angular distance being operable to drive the second transmission means and thereby to drive the first driving means in the first direction through an angular distance corresponding to the second angular distance; and an anti-coin return spring disposed for movement from a normal position in the path of travel of the coin to a displaced position out of the path of travel by the coin moving in the first angular direction and thereafter to return to its normal position upon passage of the coin beyond the spring to prevent the coin from moving in a second angular direction opposite to the first angular direction; wherein the improvement comprises:

an anti-slug mechanism including a stop carried on the anti-coin return spring and a projection carried on the second transmission means, said projection being driven into abutment with said stop as the second driving means is rotated through the first predetermined angular distance when the anti-coin return spring is in its normal position, thereby to restrict the maximum rotation of the second driving means; and the anti-coin return spring carrying said stop out of the path of travel of said projection when the spring is moved to its displaced position thereby to allow the second driving means to rotate through the second predetermined angular distance.

2. An anti-slug mechanism for use in combination with a coin operated device of the type having a movable coin carrier operable when carrying a predetermined sized coin along a predetermined path for a predetermined distance to operate the device; an anti-coin return spring disposed for movement from a normal position in the path of travel of the coin to a displaced position out of the path of travel by movement of the coin in a first direction and thereafter to return to its normal position upon passage of the coin beyond the spring to prevent the coin from moving in a second direction opposite to the first direction, said anti-slug mechanism comprising:

a stop carried on the anti-coin return spring; and a projection carried on the coin carrier, said projection being driven into abutment with said stop before the coin carrier is moved through the predetermined distance when the anti-coin return spring is in its normal position, thereby to restrict the movement of the coin holder to a distance less than the predetermined distance necessary to operate the device; and the anti-coin return spring carrying said stop out of the path of travel of said projection when the predetermined sized coin is carried by the carrier moving said spring to its displaced position, thereby to allow the coin carrier to move through the predetermined distance to operate the device.

3. In a coin operated timing device as claimed in claim 1, said stop being a cut-out portion in the anti-coin return spring, said projection being operable to engage an edge of said cut-out portion upon movement of the coin holder when said spring is in its normal position.

4. In an anti-slug mechanism as claimed in claim 2, said stop being a cut-out portion defined in the anti-coin return spring, said projection being operable to engage an edge of said cut-out portion upon movement of the coin holder when said spring is in its normal position.

* * * * *